US005173040A

United States Patent [19]

Yamazawa et al.

[11] Patent Number: 5,173,040

[45] Date of Patent: Dec. 22, 1992

[54] AIR COMPRESSOR

[75] Inventors: Tatsuya Yamazawa, Sagamihara; Iwao Ohtani, Yokohama; Gen Kano, Yokohama; Hiroshi Mitsuhashi, Yokohama, all of Japan

[73] Assignee: Tokico Ltd., Kawasaki, Japan

[21] Appl. No.: 658,094

[22] Filed: Feb. 20, 1991

[30] Foreign Application Priority Data

Feb. 20, 1990 [JP] Japan ..... 2-15778[U]

[51] Int. Cl.[5] ..... F04B 39/10

[52] U.S. Cl. ..... 417/571; 137/851

[58] Field of Search ..... 417/571, 570; 137/851

[56] References Cited

U.S. PATENT DOCUMENTS 2,559,067 7/1951 Doeg ..... 417/571

4,778,360 10/1988 Ikeda et al. ..... 417/571

FOREIGN PATENT DOCUMENTS 2311720 9/1973 Fed. Rep. of Germany ..... 137/851

*Primary Examiner*—Richard A. Bertsch

*Assistant Examiner*—Charles Freay

*Attorney, Agent, or Firm*—Scully, Scott, Murphy & Presser

[57] ABSTRACT

An air compressor comprises a cylinder, a suction valve body operatively combined with the cylinder, wherein the suction valve body is in a form of a band plate having a shape of V-letter with a round bottom, both ends of the suction valve body being arranged outside a projection space of the cylinder and a portion of the suction valve body other than the both ends being arranged inside the projection space of the cylinder, and wherein the air compressor comprises a suction valve plate receptor which can overlap the suction valve body when the suction valve body is in suction stroke and which has a rigidity enough to restrict an amount of lift of the suction valve body.

10 Claims, 3 Drawing Sheets

FIG. 1 *(Prior Art)*
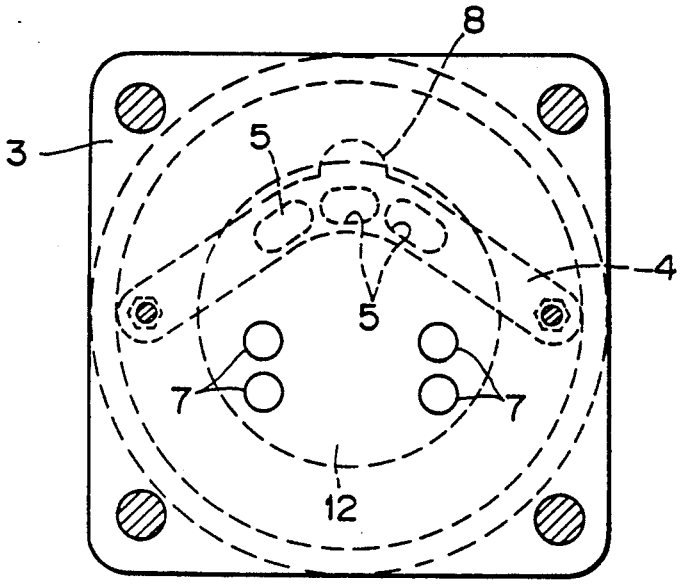
FIG. 2 *(Prior Art)*
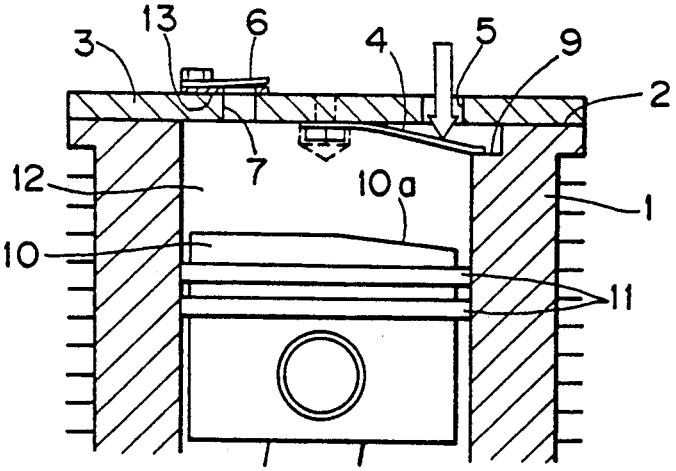

AIR COMPRESSOR

BACKGROUND OF THE INVENTION

1. Field of the Invention

The present invention relates to an air compressor of middle or large size which includes an improved suction valve.

2. Prior Art

Referring to FIG. 1 which is a horizontal cross section of a conventional air compressor and FIG. 2 which is a longitudinal cross section of main parts of the conventional air compressor illustrated in FIG. 1.

The conventional air compressor, as described in Japanese Patent Application No. 31615/1989, includes a cylinder 1 on which is provided through a packing 2 a valve seat plate 3 and a cylinder head (not shown). A suction valve plate 4 something like a cantilever (a lead valve) is fitted on a lower surface of the valve seat plate 3. The suction valve plate 4 is of a shape of V-letter with a round bottom, or of a construction having two shanks generally in the form of straight bands integrally connected with each other through a central curved portion, both ends of which are attached to the valve seat plate 3 so that the ends can be arranged on a diametral line of the cylinder 1. The valve seat plate 3 is formed with three suction holes which can be closed and reopened by the suction valve plate 4. A rectangular discharge valve plate 6 is fitted on an upper surface of the valve seat plate with one end thereof being fixed like a cantilever (a lead valve). The discharge valve 6 can close and reopen a discharge hole 7 formed in the valve seat plate. This type of conventional air compressor also has a protrusion 8 which is provided on the curved portion of the suction valve plate 4. The protrusion 8 is engageable with a cavity or concave 9 formed on an inner periphery of top end surface of a side wall of the cylinder. This construction ensures the suction valve plate 4 of reliable actuation.

In a suction stroke, a piston 10 moves from top dead center to bottom dead center and a suction valve is opened, along with which the open air is sucked through the suction holes 5 in the cylinder 1 via a suction chamber of the cylinder head. On the other hand, in a compression stroke, the piston 10 moves from the bottom dead center to the top dead center and the suction valve is closed, and as soon as the air in the cylinder 1 reaches a predetermined pressure, the discharge valve is opened so that the pressurized air can be fed out to an air tank (not shown) from a discharge chamber of the cylinder head through the discharge hole 7 via piping connected to the discharge chamber. A recess 10*a* is provided on a head of the piston 10 in order to avoid interference of the suction valve plate 4. The piston 10 is provided with a piston ring 11. A piston chamber 12 is defined the piston 10, the side wall of the cylinder 1 and the valve seat plate 3 on the top of the cylinder 1.

The conventional air compressor of the above-described construction is advantageous in many respects; for example, it has a small gap volume and therefore it requires less reexpansion, it has a large cross section of suction gas flow path, which makes it possible to reduce flow speed of the suction gas, resulting in that flow resistance is low and opening speed of the suction valve decreases, and thus seating speed of the suction valve plate 4 can be decreased. The is advantageous from a point of view of the strength of the suction valve seat 4. Further, the characteristic frequency of the suction valve plate 4 can be increased, giving rise to improved response of the suction valve to its opening and closing.

However, the above-described conventional air compressor has a problem that the base portion of the protrusion 8 tends to be damaged and stress concentration tends to occur in the suction valve plate 4 when it is lifted because the lift amount of the suction valve plate 4 is determined by contact of the protrusion 8 of the V-form suction valve plate 4 with the concave 9 in the cylinder.

Furthermore, the portion between the fitting portion to which the suction valve plate 4 is fitted and the protrusion 8 vibrates as being fanned by suction gas because no restriction is posed on the amount of lift of that portion and abrasion occurs between the concave 9 and the protrusion 8. As a result, the base portion of the protrusion 8 tends to be damaged.

Even when the conventional air compressor has an unloader mechanism of a type such that a push rod is actuated to release the suction valve as soon as the discharge pressure reaches a predetermined pressure, the portion between the fitting portion to which the suction valve plate 4 is fitted and the protrusion 8 is fanned by the suction gas and vibrates because there is no restriction on the amount of lift of that portion as described above. In this case too, abrasion occurs between the concave 9 and the protrusion 8, resulting in that the base portion of the protrusion 8 tends to be damaged.

SUMMARY OF THE INVENTION

It is an object of the present invention to provide an air compressor which is free of the above-described problems encountered in the conventional air compressor.

Under the circumstances, intensive investigation has been made to solve the above-described problems, and as a result it has now been found that the provision of a suction valve plate receptor for receiving the whole lower surface of the suction valve can prevent the occurrence of stress concentration in the suction valve body when it is lifted, and of damages of the suction valve body due to its vibration.

Therefore, the present invention provides an air compressor comprising a cylinder, a suction valve body operatively combined with the cylinder, wherein said suction valve body is in a form of a band plate having a shape of V-letter with a round bottom, both ends of said suction valve body being arranged outside a projection space of said cylinder and a portion of said suction valve body other than said both ends being arranged inside said projection space of said cylinder, and wherein said air compressor comprises a suction valve plate receptor which can overlap said suction valve body when said suction valve body is in suction stroke and which has a rigidity enough to restrict an amount of lift of said suction valve body.

The air compressor of the present invention can prevent the occurrence of stress concentration in the suction valve body when it is lifted by the overlapping of the suction valve body on the suction valve body receptor at the time of lifting of the suction valve body and also prevent damages which would otherwise occur in the suction valve body due to its abrasion as a result of its vibration.

BRIEF DESCRIPTION OF ACCOMPANYING DRAWINGS

FIG. 1 is a horizontal cross section of a conventional air compressor;

FIG. 2 is a longitudinal cross section of main parts of the conventional air compressor illustrated in FIG. 1;

DESCRIPTION OF PREFERRED EMBODIMENT

Figure 3:
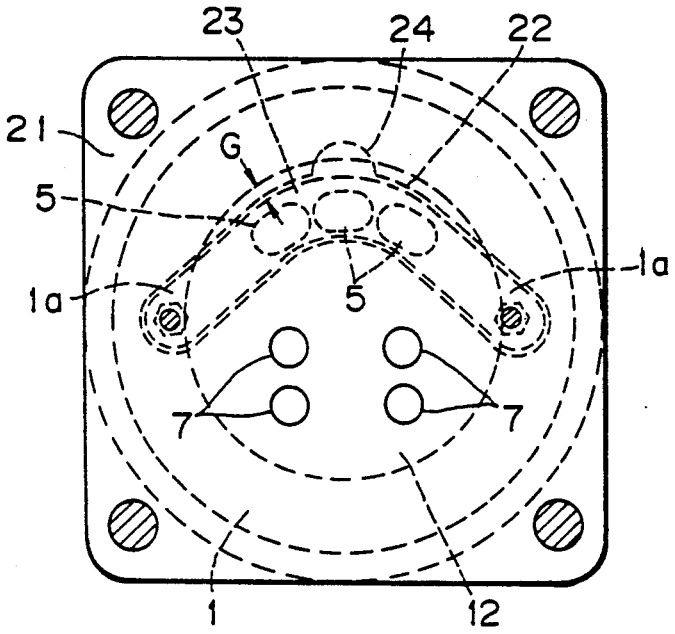
FIG. 3 is a horizontal cross section of the air compressor according to one embodiment of the present invention.
Figure 4:
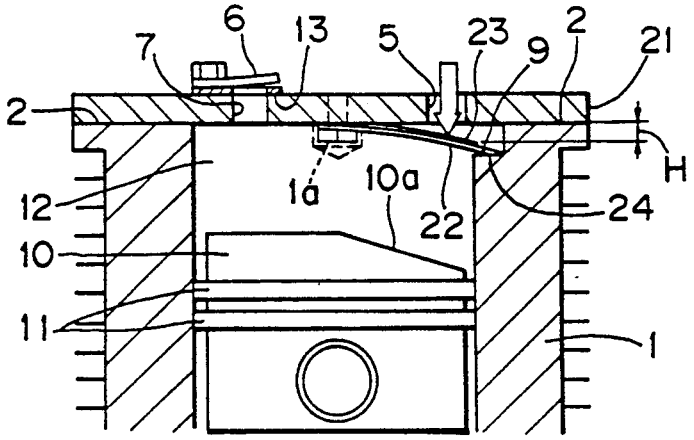
FIG. 4 is a longitudinal cross section of main parts of the air compressor illustrated in FIG. 3.

Now, referring to FIGS. 3 and 4, the air compressor according to a preferred embodiment of the present invention will be described in greater detail hereafter. In this embodiment, the same reference numerals are used for the same members or parts as those used in the conventional air compressor, and detailed explanation will be omitted partly.

This embodiment is directed to a medium or larger size air compressor. A valve seat plate 21 is formed with three suction holes 5 positioned above a portion of a cylinder chamber 12 along the inner periphery of a cylinder 1, the three suction holes being arranged so that they confront a cylinder chamber 12 and a suction chamber (not shown) of a cylinder head. The suction holes are formed each in the form of a slot at a predetermined small distance between two adjacent holes. On the lower surface of a valve seat plate 21 is provided a suction valve plate (suction valve body) 23 which is made of a band-like plate material having a curved portion in the middle of it. In other words, the suction valve plate 23 which is substantially of a shape of V-letter is positioned such that a portion of the suction valve plate which undergoes flexural deformation can be arranged within a projection space of the cylinder 1. That is, the suction valve plate 23 is provided so that the plate 23 confronts the cylinder chamber 12. Both end side portions of the suction valve plate 23 are of a straight line. The both ends of the suction valve plate 23 are positioned on a diametral line of the cylinder 1, and fixed on the lower surface of the valve seat plate 21 positioned above near inner wall of the cylinder 1. The respective suction holes 5 and the suction valve plate 23 together constitute a suction valve.

On the lower surface of the valve seat plate 21 is fitted a suction valve receptor plate (suction valve body receptor) 22 positioned below the suction valve plate 23 and having an appropriate rigidity, with both ends thereof being superimposed on the both ends of the suction valve plate 23 and fixed together by bolts. The suction valve receptor plate 22 is made of a band plate of the same shape as the suction valve plate 23 but having a slightly larger width than the suction valve plate 23. In the middle of the band plate is provided a protrusion 24 for engaging with a concave 9 formed on the top surface of the side wall of the cylinder 1.

The suction valve receptor plate 22 is positioned just below the suction valve plate 23. The both ends of the suction valve receptor plate 22 are positioned outside the projection space of the cylinder 1 and on a diametral line of the cylinder 1 and fixed on the lower surface of the valve seat plate 21 as described above so that when the suction valve plate 23 is largely dislocated in a suction stroke the plate 23 can overlap the suction valve receptor plate 22 and on the other hand the protrusion 24 can always be in contact with the bottom of the concave 9 but not limited in a suction stroke. The both ends of the suction valve receptor plate 22, the both ends of the suction valve plate 23, bolts for fixing these ends and portions near the ends are housed in an escape concave la formed on an inner periphery on the top surface of the cylinder 1. Amount of lift H of the suction valve plate 23 at an outer end of its curved portion is defined by a distance H from the lower surface of the valve seat plate 21 to a position at which the suction valve plate 23 contacts the suction valve receptor plate 22 or the plate 23 is superimposed on the suction valve receptor plate 22.

The distance between the outer periphery of the curved portion of the suction valve plate 23 (periphery of the suction valve plate 23 on the side of the inner wall surface of the cylinder 1) and the inner wall surface of the cylinder 1 is a distance indicated by a symbol G in FIG. 1. The distance G is made no smaller than the amount of lift H.

The valve seat plate 21 is formed with four discharge holes 7 such that the holes 7 confront the cylinder chamber 12 and the discharge chamber (not shown) of the cylinder head. The discharge holes 7 are positioned on both sides of and near a diametral line passing the protrusion 24 and the center of cross section of the cylinder chamber 12. The discharge holes 7 are closable by a discharge valve plate 6 which is superimposed on an underlying discharge valve receptor plate 13 and one end of which is fixed to the valve seat plate 21. The discharge valve receptor plate 13 is superimposed on the valve seat plate 21 and has a hole which forms a part of the discharge hole 7. The discharge hole 7 and the discharge valve plate 6 together constitute a discharge valve.

When the air compressor is operated and a piston 10 starts to move downward in a suction stroke, the pressure in the cylinder chamber 12 becomes lower than the atmospheric pressure, resulting in that the suction valve plate 23 starts to be dislocated downward to suck air into the cylinder 1 and the whole surface of the suction valve 23 contacts the suction valve receptor plate 22 and superimposed thereon, thereby restricting the amount of lift of the suction valve plate 23. In this case, the suction valve plate 23 is not fanned by suction gas because the suction valve receptor plate 22 has a sufficient rigidity so that the vibration of the suction valve plate 22 can be prevented, thus avoiding abrasion of the suction valve plate 23 due to vibration and therefore preventing damages of the suction valve plate 23.

When the suction valve plate 23 is lifted, it overlaps the suction valve receptor plate 22 entirely and therefore no stress concentration does occur in the suction valve plate 23.

According to the instant embodiment, the suction valve 23 has mixed characteristics, i.e. characteristics of a fixed beam because the both ends of the suction valve plate 23 are fixed to the valve seat plate 21 and characteristics of a cantilever because one end of the suction valve plate 23 is fixed and another is free end, and the both end sides of the suction valve plate 23 are of a straight line. As a result, the rigidity of the suction valve plate 23 is relatively high considering that it is used in an air compressor of a medium or large size which includes a cylinder whose diameter is much larger than that of a cylinder used in air compressor of a small size. Because the suction valve plate 23 is V-shaped, a plurality of slot-like holes can be provided along the inner wall of the cylinder, which makes it possible to increase the cross sectional area of flow path for suction air to attain high compression performance. Therefore, there is no need for particularly increasing or decreasing the amount of lift of the suction valve plate 23 to sacrifice its air suction performance, resulting in good followability of operation, and reduced gap volume. As described above, the suction valve can be applied widely to air compressors of medium or large sizes to increase their performance.

Also, in the case where an unloader mechanism is used which is of a type such that the suction valve is released by a push rod when discharge pressure reaches a predetermined value, overlapping of the suction valve plate 23 and the suction valve receptor plate 22 upon unloading prevents vibration of the suction valve plate which would otherwise occur when the plate is fanned by suction gas, resulting in that the occurrence of damages of the suction valve plate 23 due to abrasion between the suction valve plate 23 and the push rod can be prevented.

Figure 5:
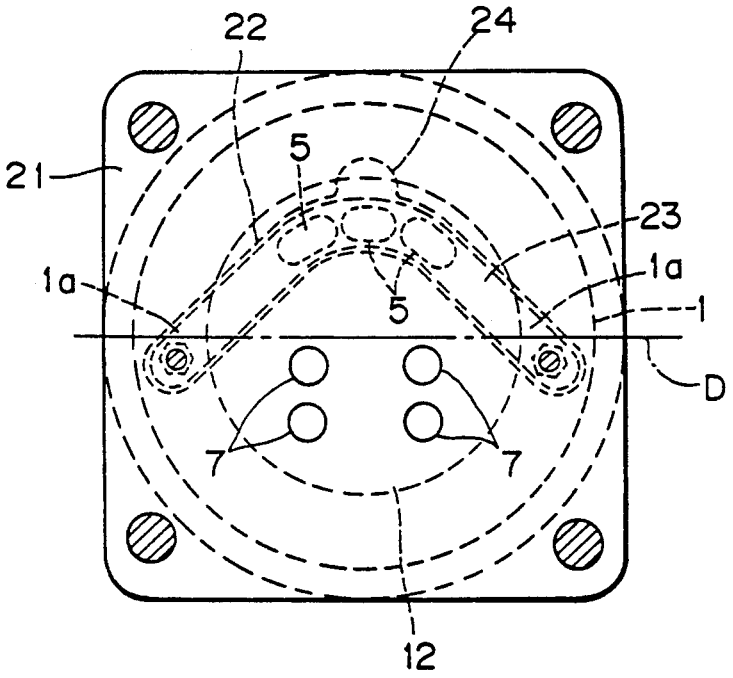
FIG. 5 is a horizontal cross section of the air compressor according to another embodiment of the present invention.

While in the above-described embodiment the both ends of the suction valve receptor plate 22 and those of the suction valve plate 23, respectively, are arranged at positions outside projection space of the cylinder 1 and on a diametral line of the cylinder and fixed to that position, the positions of the both ends of the suction valve receptor plate and the suction valve plate are not limited thereto. For example, as illustrated in FIG. 5, the both ends of the suction valve receptor plate 22 and those of the suction valve plate 23, respectively, may be fixed to positions outside the projection space of the cylinder 1 and across a diametral line D of the cylinder 1 on the side opposite to the protrusion 24 at an appropriate distance from the line D.

The above-described construction enables control of the entire length of the suction valve plate 23 and therefore makes it possible to set up the characteristic frequency of the suction valve plate 23 in accordance with a desired response speed and to reduce the distance between fitting portions where the suction valve plate 23 is to be fitted so that the air compressor can be made compact.

What is claimed is:

1. An air compressor comprising:

a cylinder;

a piston fitted into a cylinder chamber within said cylinder in a manner so that said piston can slide along said cylinder chamber;

a valve seat plate which has suction holes and at least one discharge hole provided at an end portion of said cylinder, therefore said valve seat plate compartmentalizing a compression chamber between said piston and said valve seat plate, inside of said cylinder chamber, wherein said suction holes are formed through said valve seat plate inside a projection space of said cylinder chamber, said suction holes are arranged at a distance from each other around a circumference of said cylinder chamber, wherein said at least one discharge hole is formed through said valve seat plate inside the projection space of said cylinder chamber;

a discharge valve plate opening and closing said at least one discharge hole;

a suction valve plate formed from a V-shaped ribbon material, connecting to an end face of said valve seat plate confronting said cylinder chamber, said V-shaped portion of which is positioned inside of the projection space of said cylinder chamber so that said V-shaped portion opens and closes all of said suction holes, both end portions of said suction valve being fixed to said valve seat plate outside of the projection space of said cylinder chamber; and a suction valve plate receptor which overlaps said suction valve plate when said suction valve plate is in suction stroke, and which has enough rigidity to restrict the amount of lift of said suction valve plate.

2. An air compressor according to claim 1, wherein said suction valve plate receptor is formed from substantially the same V-shaped ribbon material as said suction valve plate, both ends of which are fixed to said valve seal plate outside of the projection space of said cylinder chamber in the same manner as in said suction valve plate.

3. An air compressor according to claim 2, wherein said suction valve plate receptor is fixed to said valve seat plate, inclining as it separates gradually from the surface of said valve seat plate.

4. An air compressor according to claim 3, wherein said suction valve plate receptor has a protruding portion at a tip thereof, said cylinder having a recess which engages with said protruding portion of said suction valve plate receptor.

5. An air compressor according to claim 1, wherein both end portions of said suction valve plate are arranged counter to a radial direction of said cylinder chamber.

6. An air compressor according to claim 5, wherein said suction valve plate receptor is formed from substantially the same V-shaped ribbon material as said suction valve plate, both ends of which are fixed to said valve seat plate outside of the projection space of said cylinder chamber in the same manner as in said suction valve plate.

7. An air compressor according to claim 6, wherein said suction valve plate receptor is fixed to said valve seat plate, inclining as it separates gradually from the surface of said valve seat plate.

8. An air compressor according to claim 7, wherein said suction valve plate receptor has a protruding portion at a tip thereof, said cylinder having a recess which engages with said protruding portion of said suction valve plate receptor.

9. An air compressor according to claim 3, wherein on the head portion of said piston, a recess is formed to avoid interference with said inclined portion of said suction valve plate receptor.

10. An air compressor according to claim 7, wherein on the head portion of said piston, a recess is formed to avoid interference with said inclined portion of said suction valve plate receptor.

* * * * *